US008301053B2

(12) United States Patent
Uto et al.

(10) Patent No.: US 8,301,053 B2
(45) Date of Patent: Oct. 30, 2012

(54) IMAGE FORMING APPARATUS INCLUDING MAIN UNIT AND PROCESS CARTRIDGE

(75) Inventors: Osamu Uto, Ebina (JP); Tetsuo Ishizuka, Ebina (JP); Fumio Furusawa, Ebina (JP); Shiroh Suzuki, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 354 days.

(21) Appl. No.: 12/719,355

(22) Filed: Mar. 8, 2010

(65) Prior Publication Data

US 2011/0076048 A1 Mar. 31, 2011

(30) Foreign Application Priority Data

Sep. 25, 2009 (JP) ..... 2009-219871

(51) Int. Cl.
*G03G 15/00* (2006.01)
*G03G 21/16* (2006.01)

(52) U.S. Cl. ..... 399/90; 399/111

(58) Field of Classification Search ..... 399/90, 399/111

See application file for complete search history.

(56) References Cited

U.S. PATENT DOCUMENTS

| | | | | |
|---|---|---|---|---|
| 4,803,521 | A * | 2/1989 | Honda | 399/111 |
| 5,907,748 | A * | 5/1999 | Kawana | 399/111 |
| 5,926,666 | A * | 7/1999 | Miura et al. | 399/90 |
| 6,014,533 | A | 1/2000 | Kawana | |
| 6,137,966 | A * | 10/2000 | Uehara et al. | 399/111 |
| 6,349,182 | B2 | 2/2002 | Otsubo et al. | |
| 6,453,136 | B1 * | 9/2002 | Yasumaru | 399/111 |
| 6,826,380 | B2 * | 11/2004 | Karakama et al. | 399/111 |
| 6,892,033 | B2 * | 5/2005 | Sunada et al. | 399/111 |
| 7,184,687 | B2 * | 2/2007 | Yamaguchi et al. | 399/111 |
| 8,121,519 | B2 * | 2/2012 | Yamaguchi et al. | 399/111 |
| 2001/0014225 | A1 | 8/2001 | Otsubo et al. | |
| 2006/0120746 | A1 * | 6/2006 | Lee et al. | 399/90 |
| 2007/0071482 | A1 | 3/2007 | Okabe | |
| 2008/0031656 | A1 | 2/2008 | Okabe | |
| 2009/0180799 | A1 * | 7/2009 | Yamaguchi et al. | 399/111 |

FOREIGN PATENT DOCUMENTS

| | | | |
|---|---|---|---|
| JP | 10-312870 | A | 11/1998 |
| JP | 11-242371 | A | 9/1999 |

OTHER PUBLICATIONS

Australian Office Action dated Apr. 7, 2011 for corresponding Australian patent application No. 2010200962.

* cited by examiner

*Primary Examiner* — Susan Lee
(74) *Attorney, Agent, or Firm* — Sughrue Mion, PLLC

(57) ABSTRACT

An image forming apparatus includes a main unit and a process cartridge including: an image holding member rotating about a rotation axis; an image developing device to develop a latent image on the image holding member; and a supporting member formed with a side face spreading in a direction of the rotation axis to support the image holding member and the image developing device and be moved in the direction to be attached/detached to/from the main unit. The main unit includes a main unit connector positioned adjacently to a side face of the supporting member of the process cartridge attached to the main unit such that a face mating with a counterpart connector faces the side face. The process cartridge includes on the side face a cartridge side connector electrically connected to the main unit side connector when the process cartridge is attached to the main unit.

6 Claims, 7 Drawing Sheets

IMAGE FORMING APPARATUS INCLUDING MAIN UNIT AND PROCESS CARTRIDGE

CROSS-REFERENCE TO RELATED APPLICATION

This application is based on and claims priority under U.S.C. 119 from Japanese Patent Application No. 2009-219871, filed on Sep. 25, 2009.

BACKGROUND

Technical Field

The present invention relates to an image forming apparatus and a process cartridge.

SUMMARY

According to an aspect of the invention, an image forming apparatus includes:

a main unit; and a process cartridge that includes:

an image holding member which rotates about a rotation axis;

a developing device which develops a latent image on the image holding member; and a supporting member which is formed with a side face spreading in a direction of the rotation axis and supports the image holding member and the developing device, and a cartridge side connector on the side face of the supporting member, wherein the process cartridge is moved in the direction of the rotation axis so as to be attached and detached to and from the main unit, the main unit includes:

a main unit connector which is arranged at a position adjacent to a side face of the supporting member of the process cartridge, which is electrically connected to the cartridge side connector when the process cartridge is attached to the main unit; and an exposure device which scans, in the direction of the rotation axis, by an exposure light beam, the image holding member included in the process cartridge attached to the main unit, and the main unit connector is arranged at a position not only being closer to a side of scanning by the exposure light beam than the process cartridge but also avoiding, with respect to the direction of the rotation axis, an area where the exposure light beam passes through.

According to an aspect of the invention, a process cartridge includes:

an image holding member which rotates about a rotation axis;

a developing device which develops a latent image on the image holding member; and a supporting member which is formed with a side face spreading in a direction of the rotation axis and supports the image holding member and the developing device, and a cartridge side connector on the side face of the supporting member, wherein the process cartridge is moved in the direction of the rotation axis so as to be attached and detached to and from a main unit, and the main unit includes a main unit connector which is arranged at a position adjacent to a side face of the supporting member of the process cartridge, which is electrically connected to the cartridge side connector when the process cartridge is attached to the main unit.

BRIEF DESCRIPTION OF THE DRAWINGS

Exemplary embodiments of the present invention will be described in detail based on the following figures, wherein.

DETAILED DESCRIPTION

In the following, exemplary embodiments of an image forming apparatus according to the present invention will be explained.

Figure 1:
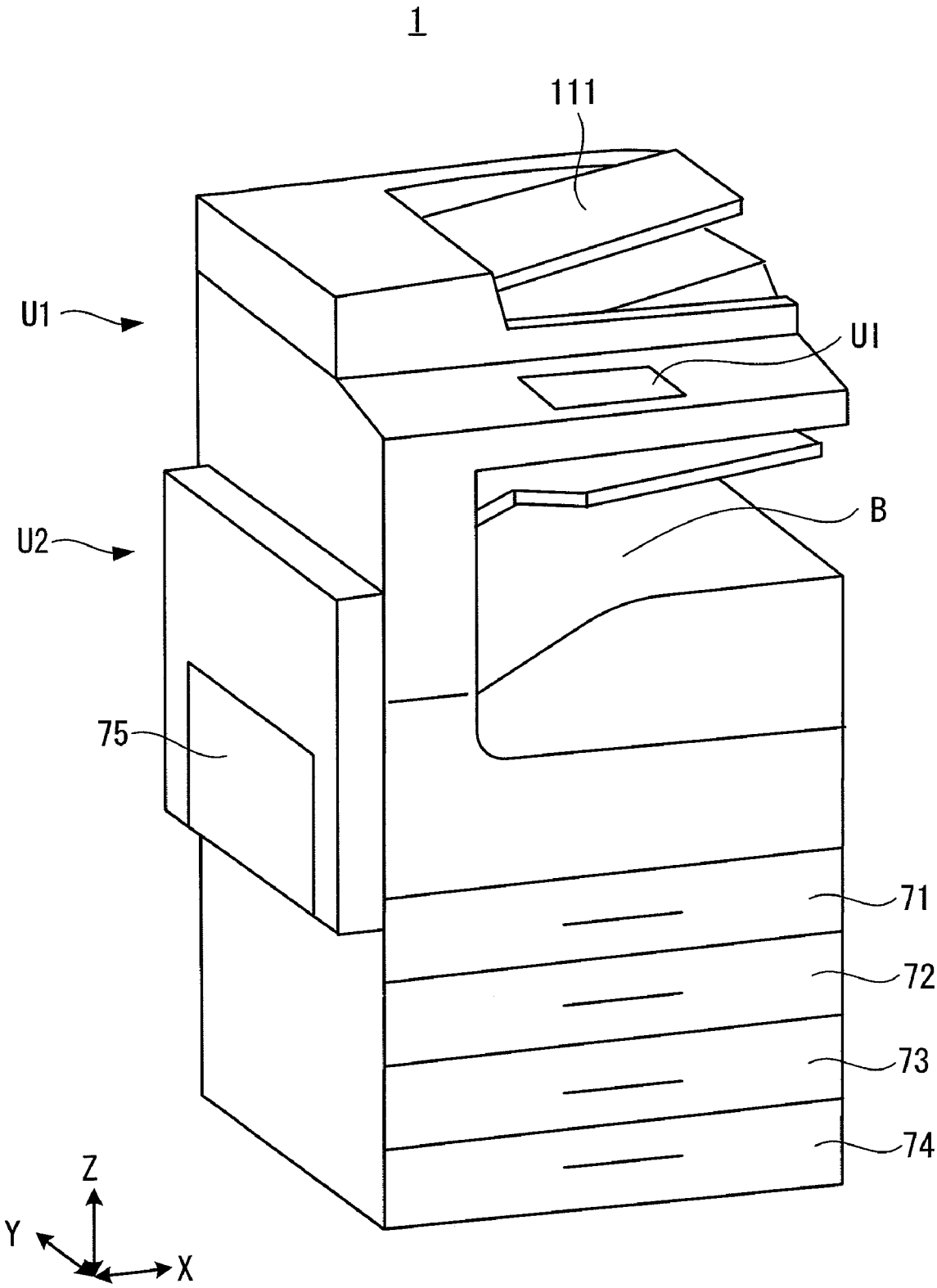
FIG. 1 is a perspective view illustrating an external appearance of a copy machine as one embodiment of the image forming apparatus according to the present invention.

FIG. 1 is a perspective view illustrating an external appearance of a copy machine as one embodiment of the image forming apparatus according to the present invention.

A copy machine 1 illustrated in FIG. 1 includes an image scanning unit U1 to scan an image from an original document and an image forming unit U2 to form an image on a sheet. The image scanning unit U1 includes an operation panel UI to display various kinds of information and to receive an operation of a user. The copy machine 1 forms an image of an original document read by the image scanning unit U1 on a sheet by the image forming unit U2. In addition, the copy machine 1 also may operate as a scanner or a printer.

The copy machine 1 according to the present exemplary embodiment employs a configuration of a so-called in-body discharge type. That is, the image scanning unit U1 is arranged above the image forming unit U2 with a space which is formed in between and in which the sheet is discharged. The sheet on which the image is formed by the image forming unit U2 is outputted and stacked on a output tray B arranged on an upper portion of the image forming unit U2. The copy machine 1 which discharges a sheet between the image scanning unit U1 and the image forming unit U2 has a small installation area comparing to, for example, a configuration in which a output tray is arranged on a side of an image forming unit and protrudes in a width direction X.

Figure 2:
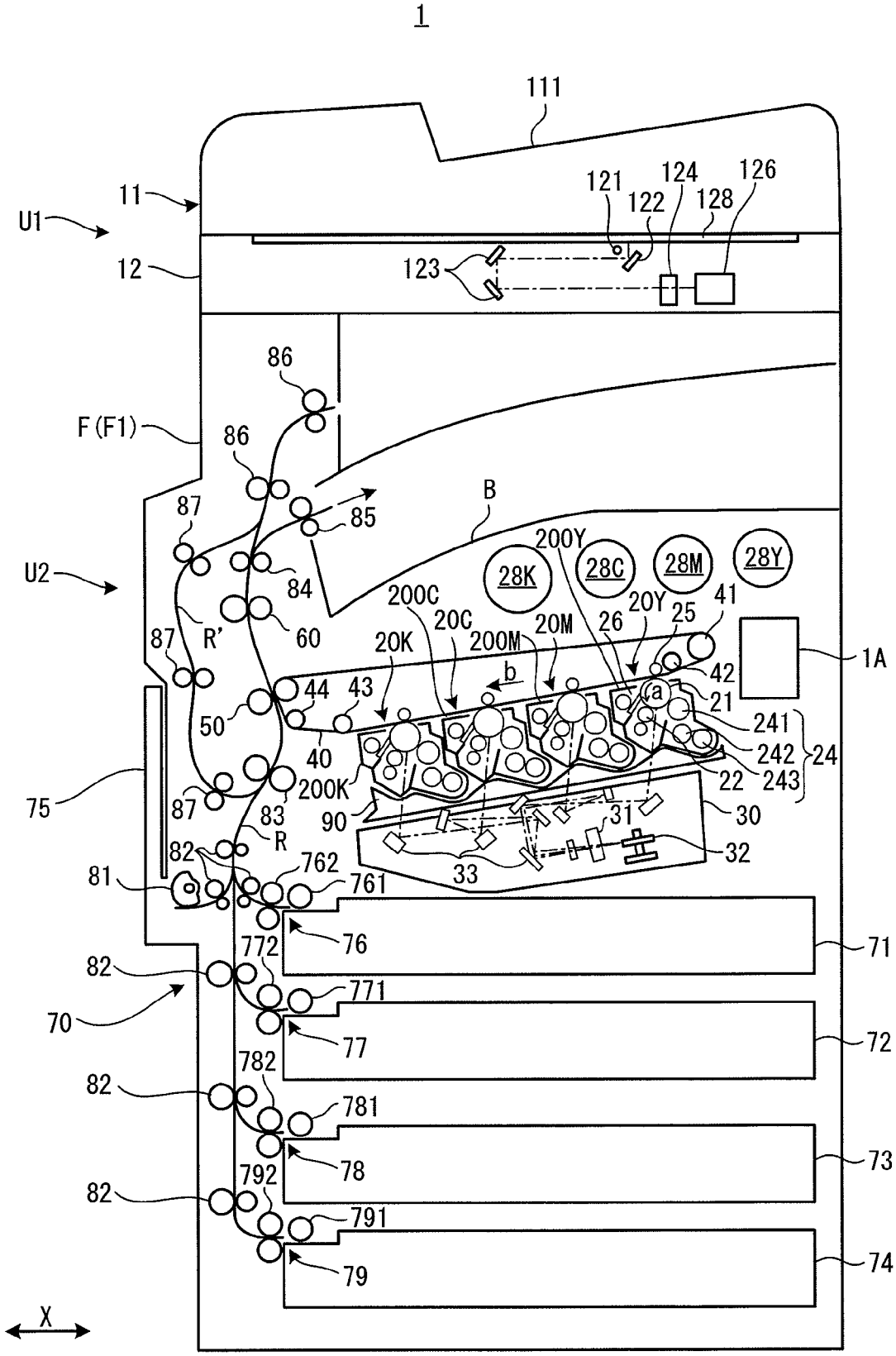
FIG. 2 is a schematic diagram illustrating an internal configuration viewed from the front of the copy machine illustrated in FIG. 1.

FIG. 2 is a schematic diagram illustrating an internal configuration viewed from the front of the copy machine illustrated in FIG. 1.

The image scanning unit U1 includes a original document sending section 11 to send a original document and a reading section 12 to scan an image from an original document.

The reading section 12 includes a light source 121 to emit light toward a original document, mirrors 122, 123 to reflect and introduce light reflected on the original document, a lens 124 to focus reflection light from the mirrors to be an image and an image receiving sensor 126 to receive an optical image formed by the light focused by the lens 124 to output image data. The original document sending section 11 is attached openably and closably on the reading section 12. A platen glass 128 is arranged on an upper face of the reading section 12. The original document sending section 11 includes an original document table 111 and a transport device (not illustrated) to take out an original document from the original document table 111 to transport the original document in the original document sending section 11.

When an original document put on the original document table 111 is transported in the original document sending section 11 to pass through a scanning position of the reading section 12, light from a pass-through portion is converted to image data via the mirrors 122, 123, the lens 124 and the image receiving sensor 126. In addition, when an original document is put on the platen glass 128 by a user, the reading section 12 reads an image from the original document while moving the mirrors 122, 123. The read image data is supplied to the image forming unit U2.

The image forming unit U2 functions as a tandem-type color printer in which image forming sections 20Y, 20M, 20C, 20K are arranged in parallel for respective colors of Yellow (Y), Magenta (M), Cyan (C) and Black (K). The image forming unit U2 may print a single color image of and may also print a full color image composed of four color toner images. Because the four image forming sections 20Y, 20M, 20C, 20K include a similar configuration except a kind of toner, the image forming section 20Y corresponding to Yellow will be explained with reference characters attached, representing those image forming sections. The image forming section 20Y includes a photoreceptor 21, a charging device 22 to charge a surface of the photoreceptor 21, a developing device 24 to develop the surface of the photoreceptor 21 by toner, a primary transfer device 25 to transfer a toner image to an intermediate transfer belt, and a photoreceptor cleaner 26 to clean up the surface of the photoreceptor 21. The photoreceptor 21 has a cylindrical surface and rotates in a direction of an arrow a around an axis of a cylinder. The developing device 24 includes a developing roll 241 to develop the photoreceptor 21 and a pair of stir and convey members 242, 243 to transport toner to be supplied to the developing roll 241 to the photoreceptor 21 while stirring the toner.

The photoreceptor 21, the charging device 22, the developing device 24 and the photoreceptor cleaner 26 of the image forming section 20Y are housed in a process cartridge 200Y which is attachable and detachable to and from the image forming unit U2. The remaining image forming sections 20M, 20C, 20K include attachable and detachable process cartridges 200M, 200C, 200K, respectively. The process cartridges 200Y-200K are slidably attached on a guide member 90 fixed to a housing F. Details of the process cartridges 200Y-200K will be explained later.

In addition, the image forming unit U2 further includes an exposure device 30 to emit an exposure beam based on image data supplied from the outside to each of the photoreceptors 21 of the image forming sections 20Y-20K, toner cartridges 28Y, 28M, 28C, 28K which house toner of respective CMYK colors, an intermediate transfer belt 40 to which toner images are transferred from the photoreceptors of the respective colors, a secondary transfer device 50 to transfer the toner images from the intermediate transfer belt 40 to a sheet, a fixing device 60 to fix the image on a sheet, a sheet transport section 70 to transport a sheet and a control section 1A to control each section of the image forming unit U2. The image forming sections 20Y-20K, the exposure device 30, the toner cartridges 28Y-28K, the intermediate transfer belt 40, the secondary transfer device 50, the fixing device 60 and the sheet transport section 70 are arranged in the housing F.

The exposure device 30 includes a light emitting device 31, a polygon mirror 32 and a light guiding mirror 33. An exposure beam emitted from the light emitting device 31 according to image data is guided by the polygon mirror 32 and the light guiding mirror 33 to be emitted to the photoreceptors 21 of the image forming sections 20Y-20K.

The intermediate transfer belt 40 is an endless-belt-shaped member supported by belt supporting rolls 41, 42, 43, 44 and moves circularly in a direction b in which the intermediate transfer belt 40 passes through the image forming sections 20Y, 20M, 20C, 20K and the secondary transfer device 50 in this order.

The sheet transport section 70 includes four sheet cassettes 71, 72, 73, 74 to house sheets, a manual-feed sheet supply section 75 to supply a sheet from the outside, sheet take out sections 76, 77, 78, 79 through which a sheet is taken out from the sheet cassettes 71, 72, 73, 74, a sheet take out section 81 through which a sheet is taken out from the manual-feed sheet supply section 75, a sheet feed roll 82 to transport a sheet taken out, a registration roll 83 to send a sheet to the secondary transfer device 50, a sheet transport roll 84 to transport a sheet on which an image is formed, an ejection roll 85 to eject a sheet and reverse transport rolls 86, 87 to transport a sheet when images are formed on both sides of a sheet.

The sheet cassettes 71-74 and the manual-feed sheet supply section 75 are arranged below the image forming sections 20Y-20K and the registration roll 83. After sheets housed in the sheet cassettes 71-74 and the manual-feed sheet supply section 75 are taken out by the sheet take out sections 76, 77, 78, 79, the sheets are then transported upwardly along a sheet transport path R via the secondary transfer device 50 and the fixing device 60 in the housing F by the sheet feed roll 82, the registration roll 83 and the sheet transport roll 84. The sheet transport path R extends in a vertical direction along a wall F1 included in the housing F. The sheet which is transported on the sheet transport path R and on which an image is formed is ejected by the ejection roll 85 onto the output tray B of the image forming unit U2. The sheet take out sections 76-79 include pick up rolls 761, 771, 781, 791 to take out a sheet and settlement rolls 762, 772, 782, 792 to settle the taken out sheet. The manual-feed sheet supply section 75 is for supplying a sheet directly from the outside of the housing F. The manual-feed sheet supply section 75 is an approximately plate-shaped member which is rotatably supported by the standing wall F1 of the housing F, and is housed standing along the standing wall F1 when not used. The manual-feed sheet supply section 75 is pulled out, as illustrated by a dashed line in FIG. 2, to be flat when used. The sheet take out section 81 takes out sheets one by one toward the sheet transport path R in a direction to the inside of the housing F.

Here, the image forming unit U2 corresponds to an example of the main unit according to the aspect of the invention. In addition, the photoreceptor 21 corresponds to an example of the image holding member according to the aspect of the invention.

Basic operations of the image forming unit U2 will be explained. In the image forming section 20Y, the photoreceptor 21 is driven to rotate in the direction of the arrow a, charge is given to a surface of the photoreceptor 21 by the charging device 21. The exposure device 30 emits an exposure beam based on image data supplied from the outside to the respective photoreceptors 21 of the image forming sections 20Y, 20M, 20C, 20K to form an electrostatic latent image. The exposure device 30 emits an exposure beam according to data corresponding to each color in an image to the photoreceptor 21 of each of the image forming sections 20Y, 20M, 20C, 20K. The explanation will be provided for Yellow (Y) as a representative example. The exposure device 30 emits the exposure beam based on image data corresponding to Yellow of the image data supplied from the outside to the surface of the photoreceptor 21 to form an electrostatic latent image on the surface of the photoreceptor 21. The developing device 24 develops the latent image by toner of Yellow to form a toner image. The developing device 24 is supplied with toner from the toner cartridge 28. In response to forming of the toner image of Yellow, the photoreceptor 21 holds the toner image. The toner image formed on the surface of the photoreceptor 21 is transferred to the intermediate transfer belt 40 by the primary transfer device 25. After transferred, the toner remaining on the photoreceptor 21 is collected and removed by the photoreceptor cleaner 26.

The intermediate transfer belt 40 is circularly moved in the direction of the arrow b by the supporting rolls 41-44. The image forming sections 20M, 20C, 20K corresponding to the colors other than Yellow forms toner images corresponding to the respective colors similarly to the image forming section 20Y and transfers the toner images of the respective colors to the intermediate transfer belt 40 while overlaying the toner images of the respective colors on the toner image transferred by the image forming section 20Y. The intermediate transfer belt 40 holds the toner images thus formed thereon and moves.

Meanwhile, from either one of the sheet cassettes 71-74 and the manual-feed sheet supply section 75, a piece of sheet is taken out by the sheet take out sections 76-79, 81. The sheet taken out is transported upwardly on the sheet transport path R by the sheet feed roll 82. The registration roll 83 sends out the sheet transported along the sheet transport path R such that the timing is adjusted to meet a starting time of image forming in the secondary transfer device 50.

The secondary transfer device 50 transfers the toner image of the intermediate transfer belt 40 to a sheet. By the secondary transfer device 50, the toner image is finally transferred to the sheet. The sheet is further transported to the fixing device 60, and the toner image transferred to the sheet is fixed, and thus forming the image on the sheet is completed. The sheet on which the image is formed is further transported by the sheet feed roll 84 and then is outputted by the discharge roll 85 onto the output tray B.

When an image is formed on the reverse side of a sheet in double-sided copy and the like, the reverse transport roll 86 once transports the sheet upwardly and then reversely transports the sheet downwardly. The sheet is transported in a state of being upside-down to the registration roll 83 by the reverse transport roll 87 via a reverse transport path R', and thus an image is formed on the reverse side.

Figure 3:
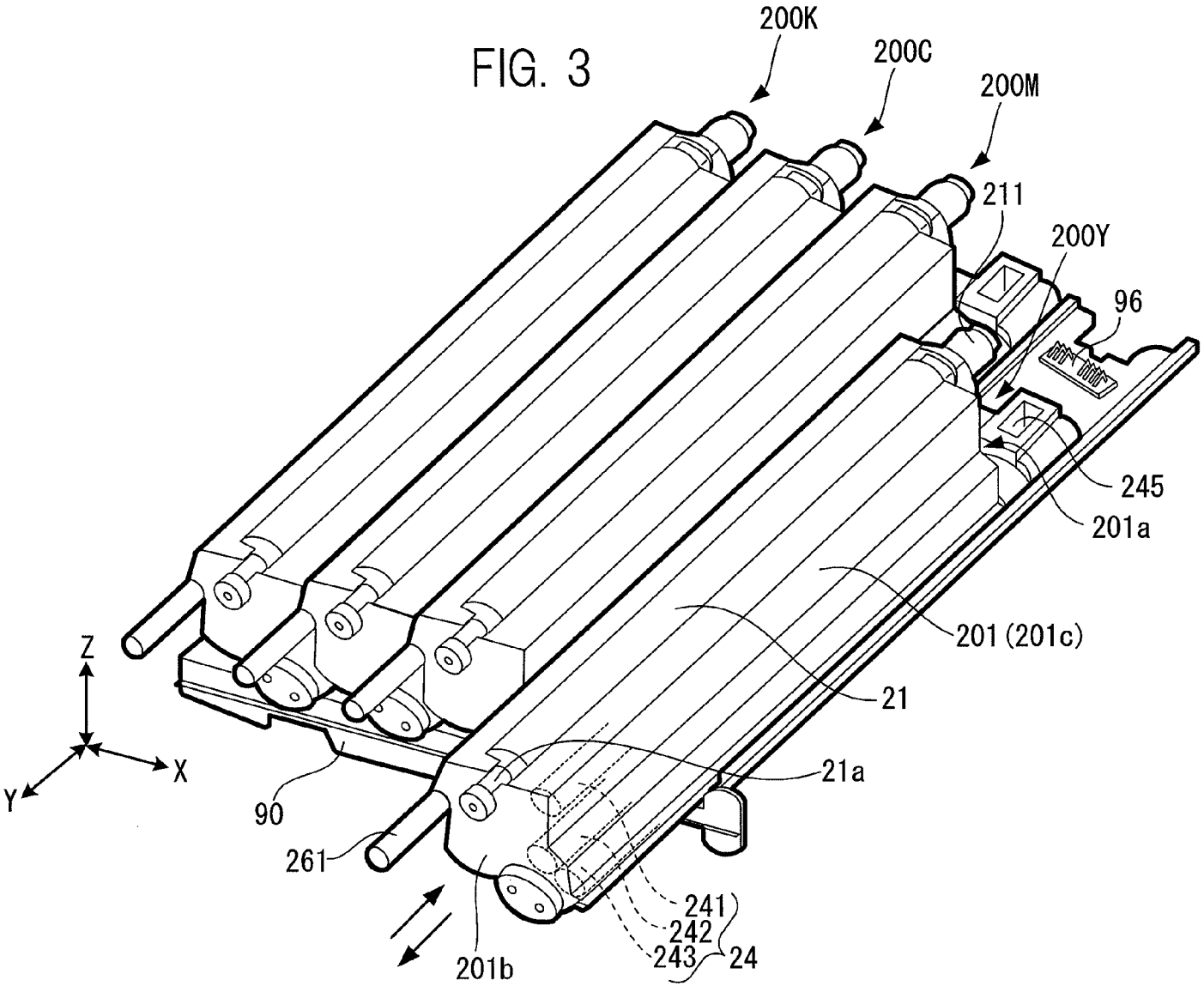
FIG. 3 is a schematic diagram illustrating an external view of a process cartridge and the guide member illustrated in FIG. 2 viewed from upper front.

FIG. 3 is a schematic diagram illustrating an external view of the process cartridge and the guide member illustrated in FIG. 2 viewed from upper front. FIG. 3 illustrates a state in which the three process cartridges 200C-200K of the four process cartridges 200Y-200K which are independently attachable and detachable are attached and the remaining process cartridge 200Y is not attached yet.

Each of the process cartridges 200Y-200K has a similar configuration. The process cartridge 200Y corresponding to Yellow will be representatively explained. The process cartridge 200Y includes a cartridge housing 201. In the cartridge housing 201, the photoreceptor 21, the charging device 22 (see FIG. 2), the developing device 24 and the photoreceptor cleaner 26 (see FIG. 2) are arranged and are supported by the cartridge housing 201. The process cartridge 200Y is moved from a front of the image forming unit U2 (see FIG. 2) in a direction in which a rotation axis 21*a* of the photoreceptor extends to be attached and detached. This rotation axis of the photoreceptor 21 is also a depth direction Y. Hereinafter, the depth direction Y is referred to also as a rotation axis direction Y.

The cartridge housing 201 has a cylindrical external shape extending in the rotation axis direction Y, and includes end faces 201*a*, 201*b* at both ends in the rotation axis direction Y and a side face 201*c* which connects the end faces 201*a*, 201*b* of the both ends and extends in the rotation axis direction Y. The end face 201*a* which is to be in a front side when the process cartridge 200Y is attached is provided with a toner receive section 245 to receive toner to be supplied to the developing device 24.

In the photoreceptor 21, a top portion contacting the intermediate transfer belt 40 (see FIG. 2) and a bottom portion to be irradiated with the exposure beam from the exposure device 30 (see FIG. 2) are exposed outside the cartridge housing 201. On the end face 201*a* of the cartridge housing 201, a connection portion 211 to couple the photoreceptor 21 to a device mechanism (not illustrated) arranged on the main unit side projects. The photoreceptor 21, the developing roll 241 of the developing device 24 and the stir and convey members 242, 243 are arranged in parallel with each other. Incidentally, in FIG. 3, a portion of the developing roll 241 and the stir and convey members 242, 243 are illustrated by dashed lines. In addition, the end face 201*b* which is to be a rear end side when the process cartridge 200Y is attached is provided with a discharge section 261 to discharge toner collected through the cleaning by the photoreceptor cleaner 26.

Figure 4:
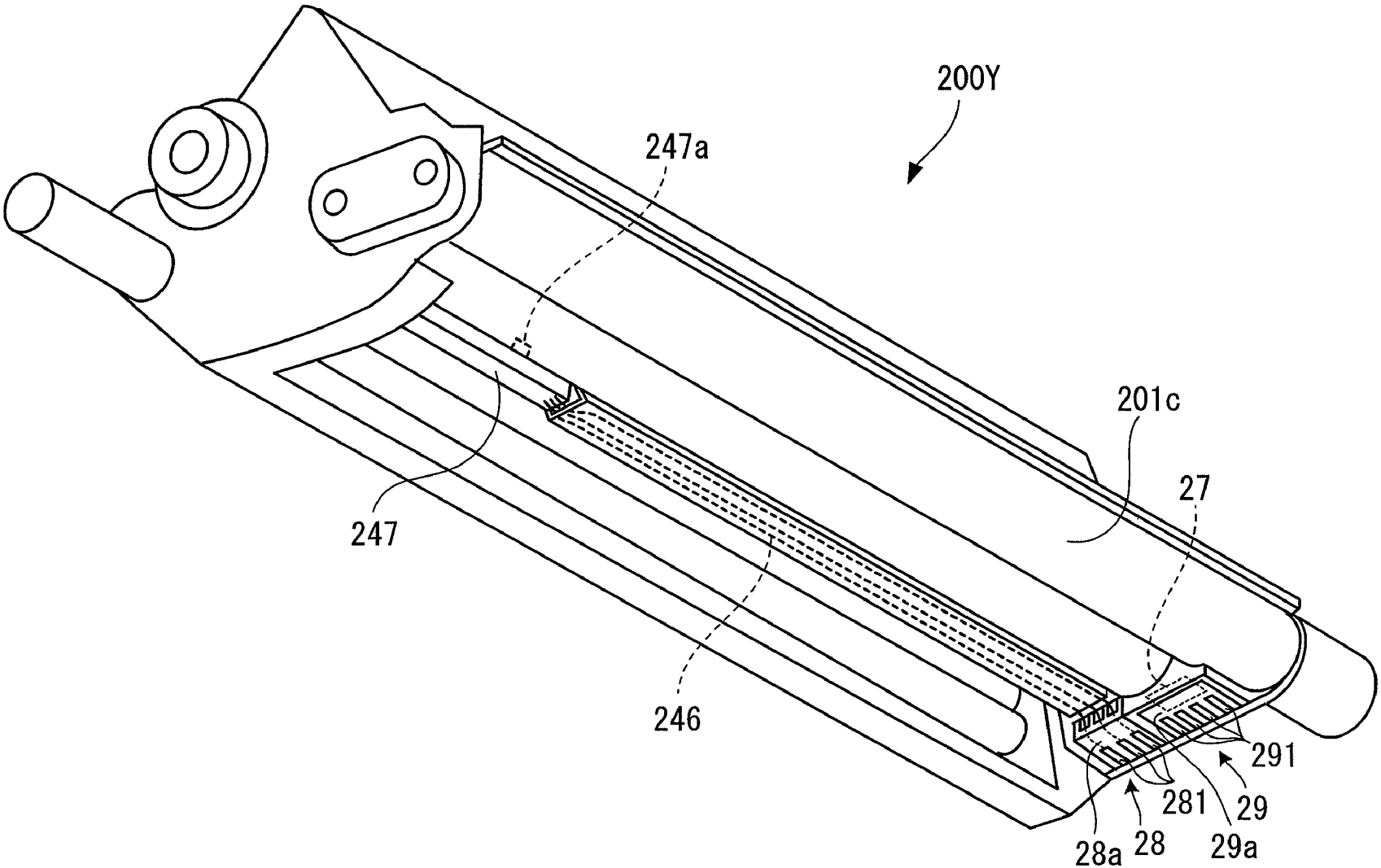
FIG. 4 is a schematic diagram illustrating an external appearance of the process cartridge illustrated in FIG. 3 when the front is viewed from lower right.

FIG. 4 is a schematic diagram illustrating an external appearance of the process cartridge illustrated in FIG. 3 when the front is viewed from lower right.

The process cartridge 200Y is provided with a sensor 247 to detect toner density, a memory element 27, two connectors of a sensor connector 28 and a memory connector 29. The sensor 247 and the two connectors 28, 29 are attached to the side face 201*c* of the cartridge housing 201. The sensor 247 is attached on an external side of the cartridge housing 201, and a detect section 247*a* passes through the cartridge housing 201 to be exposed in the developing device 24. The sensor 247 detects toner density of the developing device 24 and outputs a signal representing the toner density, the sensor 247 is connected to the sensor connector 28 by a leading wire 246 arranged in a cover.

The sensor connector 28 and the memory connector 29 are arranged adjacently to each other. The sensor connector 28 and the memory connector 29 are electrically connected to a main unit side connector 96 (see FIG. 3) when the process cartridge 200 is attached. On a connecting face 28*a* of the sensor connector 28, three connecting terminals 281 are arranged. On a connecting face 29*a* of the memory connector 29, four connecting terminals 291 are arranged.

In the memory element 27, information representing a state of the process cartridge 200 is stored. For example, a color of toner treated by the process cartridge 200 or a history of a number of images formed are stored. Into the memory element 27, information stored by the control section 1A of the image forming unit U2 is read. In addition, information is written in by a control section 1A, and information is also written in a production stage of the process cartridge 200 before being connected to the control section 1A. The memory element 27 is arranged in deep behind the memory connector 29 and is electrically connected to the memory connector 29.

Here, the cartridge housing 201 corresponds to an example of the supporting member according to the aspect of the present invention. In addition, the sensor connector 28 corresponds to an example of the cartridge side connector according to the aspect of the present invention. Further, the memory element 27 corresponds to an example of the storage device according to an aspect of the present invention.

Figure 5:
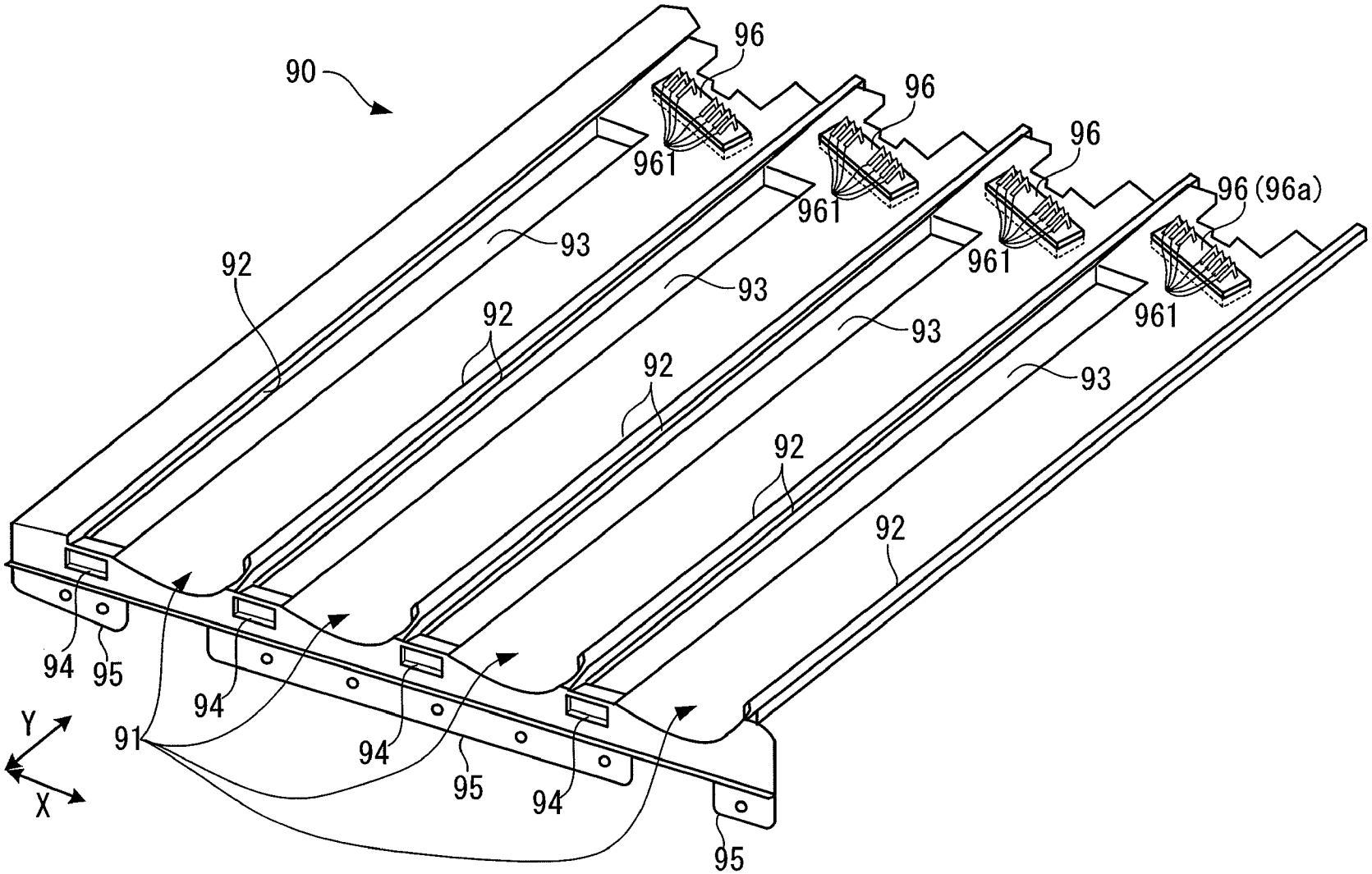
FIG. 5 is a perspective view illustrating the guide member illustrated in FIG. 3.

FIG. 5 is a perspective view illustrating the guide member illustrated in FIG. 3.

In the guide member 90 illustrated in FIG. 5, four cartridge mount sections 91 where the four process cartridges 200Y-200K (see FIG. 3) are arranged side-by-side in the width direction X. On both sides of each of the cartridge mount sections 91 are provided guide rails 92 extending in the depth direction Y. The process cartridges 200Y-200K are guided to move in the depth direction Y and to be attached to the guide member 90. In addition, each of the cartridge mount sections 91 is provided also with a light pass-through opening 93 to let the exposure beam from the exposure device 30 pass through and a cleaning window 94 to insert a cleaning tip to clean the exposure device 30. In addition, the guide member 90 is provided also with a fixing section 95 to fix the guide member 90 to the housing F of the image forming unit U2 by using a screw and the like.

In a deeper side in the depth direction Y than the light pass through opening 93 of each of the cartridge mount sections 91, four main unit side connectors 96 are arranged. Each of the main unit side connectors 96 is provided with seven terminals 961. The terminals 961 are formed of thin leaf spring and project in a shape of rising upwardly from the connecting face 29*a*. Each of the main unit side connectors 96 is attached such that the connecting face 29*a* provided with the terminals 961 faces upward, that is, each of the main unit side connectors 96 penetrates the guide member 90 toward the process cartridges 200Y-200K in the attached state. Each of the main unit side connectors 96 is connected through a conductive wire (not illustrated) to the control section 1A (see FIG. 2).

In assembling of the copy machine 1, since the main unit side connectors 96 are attached to the guide member 90, firstly, as illustrated in FIG. 5, the four main unit side connectors 96 are attached to the guide member 90 for each of the conductive wires, and subsequently, the guide member 90 is fixed to the housing. With this, arranging of the guide member 90 and arranging of the main unit side connectors 96 are performed collectively, and so a work to attach the connectors each as a single unit in the deep side of the inside of the copy machine 1 may be omitted. Thus, the work may be reduced comparing to the case of attaching the connectors each as a single unit.

Figure 6:
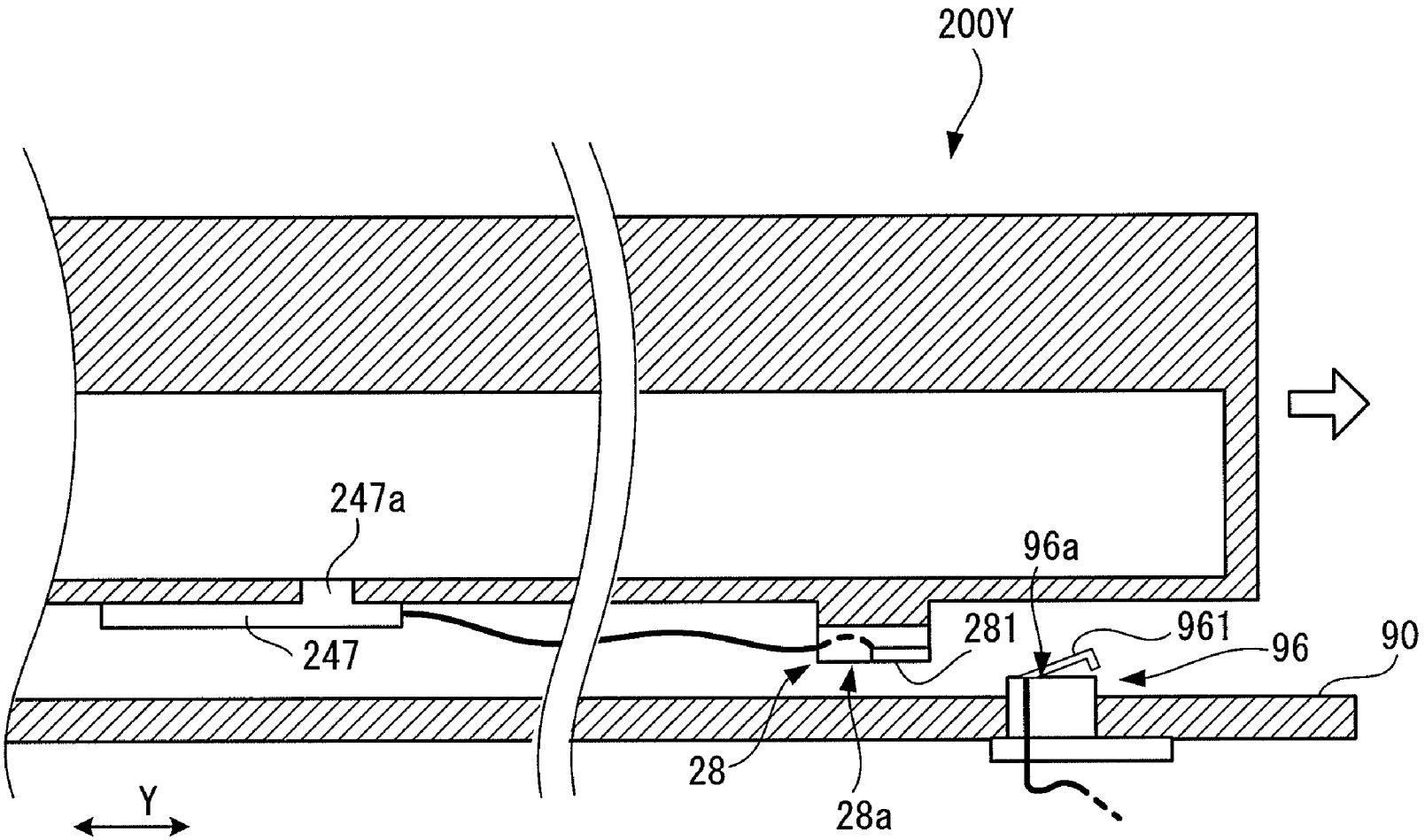
FIG. 6 is a schematic cross-sectional view illustrating a part of the guide member and the process cartridge illustrated in FIG. 4.

FIG. 6 is a sectional schematic view illustrating a part of the guide member and the process cartridge illustrated in FIG. 4. FIG. 6 illustrates a state of the process cartridge before attaching has not been completed.

The process cartridge 200Y is further pushed in the depth direction Y from the state illustrated in FIG. 6, and the attachment is completed at a position where the sensor connector 28 and the memory connector 29 are electrically connected to the main unit side connector 96. In the state where the process cartridge 200Y is attached, the connecting terminals 281 of the sensor connector 28 and the connecting terminal 291 of the memory connector 29 (see FIG. 4) push downwardly the connecting terminals 961 of the main unit side connectors 96, thereby contacting the connecting terminal 961. Therefore, the connecting terminals 961 are pushed to abut on the connecting terminals 281 and the connecting terminals 291 by an elastic force, so that a contact failure is avoided even in a case of receiving a vibration or the like.

When the sensor connectors 28 and the main unit side connector 96 are electrically connected, the signal outputted from the sensor 247 is supplied via the sensor connector 28 and the main unit side connector 96 to the control section 1A (see FIG. 2). In addition, to the main unit side connector 96 of the guide member 90, the memory connector 29 (see FIG. 4) connected to the memory element 27 is also connected, and the control section 1A writes information in the memory element 27 or reads information from the memory element 27.

Figure 7:
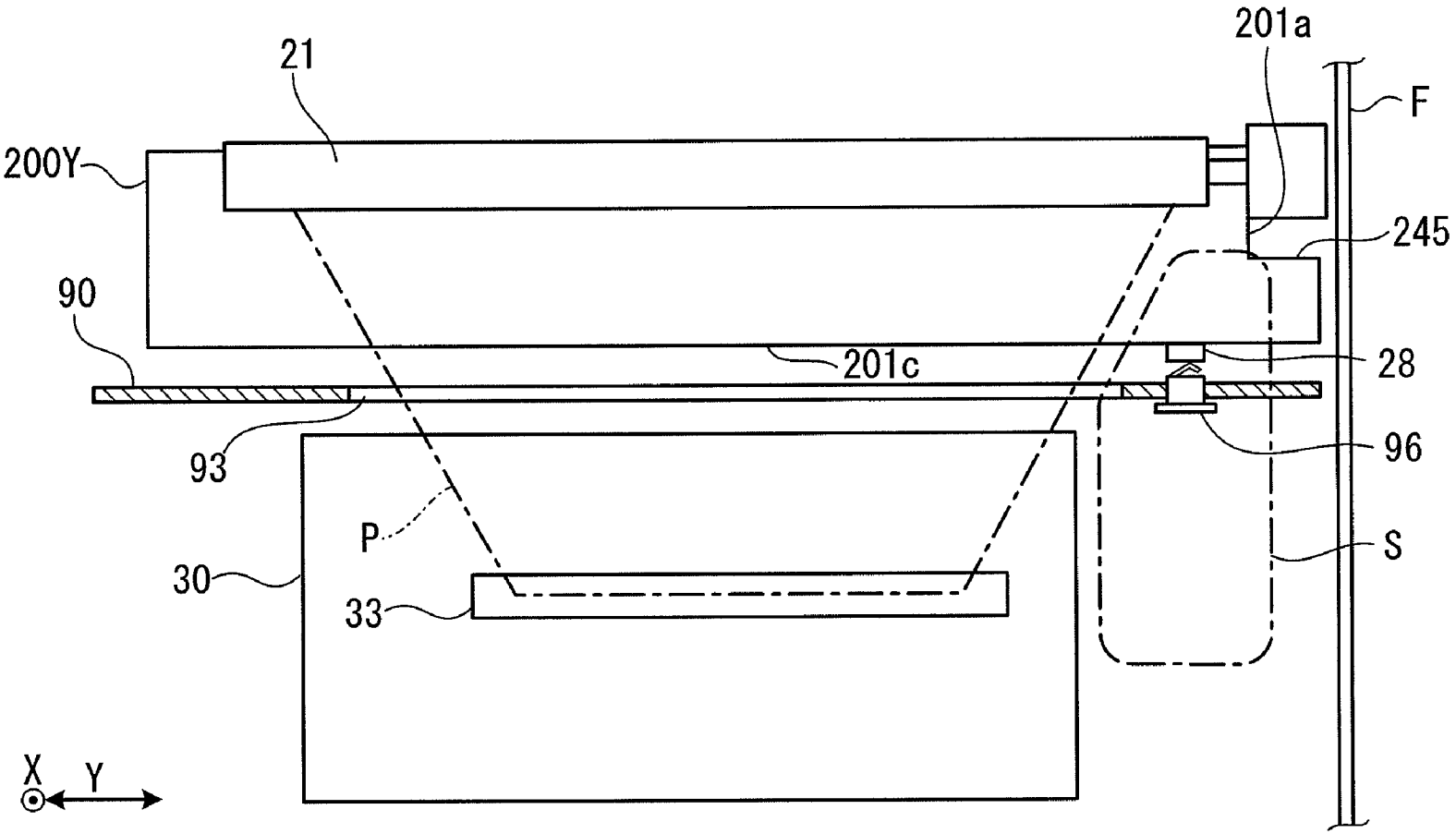
FIG. 7 is a schematic cross-sectional view to explain a position relation between the process cartridge and a connector in a state where they are attached to each other.

FIG. 7 is a schematic cross-sectional view to explain a position relation between the process cartridge and a connector in an attached state. FIG. 7 illustrates a position relation of the process cartridge 200Y, the guide member 90 and the exposure device 30 viewed in the width direction X.

The photoreceptor 21 of the process cartridge 200Y is scanned by the exposure beam from the exposure device 30 in a rotation axis direction, i.e., in the depth direction Y. The exposure beam is reflected by the light guiding mirror 33 in the exposure device 30 and passes through the light pass through opening 93 of the guide member 90 to be emitted to a lower portion of the photoreceptor 21. A length in which the exposure beam scans on the photoreceptor 21 is determined according to a range in which the copy machine 1 may form an image on a sheet. In addition, a pass through area P of the exposure beam expands as coming closer to the photoreceptor 21 with respect to the depth direction Y, and inversely, narrows as coming downwardly. For this reason, under the photoreceptor 21, there is a space S through which the exposure beam does not pass. This space S expands as coming closer to the exposure device 30 from the photoreceptor 21.

The main unit side connector 96 is arranged on a side closer to a side of scanning by the exposure beam than the process cartridge 200Y, i.e., under the process cartridge 200Y, at a position to avoid the pass through area P of the exposure beam. That is, the space S where the exposure light does not pass is utilized to arrange the main unit side connector 96 on the side of the guide member 90.

In a deeper place than the end face 201*a* of the process cartridge 200Y are arranged the toner receiving section 245 and the mechanism to drive and thereby rotate the photoreceptor 21. In addition, over the process cartridge 200Y, the primary transfer device 25 and the intermediate transfer belt 40 (see FIG. 2) are arranged and there is no space for arranging a connector. Here, if a connector is arranged on a tip of the toner receiving section 245 of the process cartridge 200Y, a space may be obtained for a connector between the toner receiving section 245 of the process cartridge 200Y and the housing F.

In the copy machine 1 according to the present exemplary embodiment, the main unit side connector 96 is provided at a position adjacent to the end face 201*c* of the process cartridge 200Y, and the sensor connector 28 and memory connector 29 are provided on the side face 201*c*, so that a distance between the process cartridge 200Y and the housing is reduced comparing to a case where a connector is provided on the tip of the toner receiving section 245, and a size in the depth direction Y of the copy machine 1 is reduced and an installation area thereof is reduced. In addition, the main unit side connector 96 is arranged at a position on a side closer to a side of scanning by the exposure beam than the process cartridge 200Y and avoiding the pass through area P of the exposure beam, so that the main unit side connector 96, the sensor connector 28 and the memory connector 29 may be arranged without leaving a space for arranging a connector between the process cartridge 200Y and the exposure device 30. Accordingly, an increase of the height of the copy machine 1 may be avoided.

Incidentally, in the above-described exemplary embodiment, the main unit side connector 96 having the seven connecting terminals is described as an example of the main unit side connector accordingly to the aspect of the present invention, the sensor connector 28 having the three connecting terminals is described as an example of the cartridge side connector according to the aspect of present invention, and the memory connector 29 having the four connecting terminals is described as an example of the storage device connector according to the aspect of the present invention. However, the present invention is not limited to these examples. For example, the respective connecting terminals may be plural other than seven, four and three, or may be single.

In addition, in the above-described exemplary embodiment, as an example of the process cartridge according to the aspect of the present invention, the process cartridge 200Y provided with the photoreceptor 21, the charging device 22, the developing device 24 and the photoreceptor cleaner 26 is described. However, the process cartridge according to the aspect of the present invention is not limited to this. For example, the process cartridge according to the aspect of the present invention may be one without a charging device or a photoreceptor cleaner, or instead, may be one provided with a transfer device.

In addition, in the above-described exemplary embodiment, the sensor connector 28 is described as an example of the cartridge side connector according to the aspect of the present invention. However, the cartridge side connector is not limited to this. For example, the cartridge side connector according to the aspect of the present invention may be one for supplying a control signal or electrical power to a component in the cartridge.

In addition, in the above-described present exemplary embodiment, as an example of the storage device according to the aspect of the present invention, the memory element arranged in a deep side of the connector is described. However, the storage device according to the aspect of the present invention is not limited to this. For example, the storage device according to the aspect of the present invention may be one arranged away from the connector.

In addition, in the above-described exemplary embodiment, the tandem-type color printer is described as an example of the image forming apparatus according to the aspect of the present invention. However, the image forming apparatus according to the aspect of the present invention is not limited to this. For example, the image forming apparatus according to the aspect of the present invention may be a printer dedicated for monochrome without an intermediate transfer belt.

Further, in the above-described exemplary embodiment, the copy machine is described as the image forming apparatus. However, the image forming apparatus according to the aspect of the present invention is not limited to this. For example, the image forming apparatus according to the aspect of the present invention may be a facsimile or a printer without an original document reading function.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

a main unit; and a process cartridge that includes:

an image holding member which rotates about a rotation axis;

a developing device which develops a latent image on the image holding member; and a supporting member which is formed with a side face spreading in a direction of the rotation axis and supports the image holding member and the developing device, and a cartridge side connector on the side face of the supporting member, wherein the process cartridge is moved in the direction of the rotation axis so as to be attached and detached to and from the main unit, the main unit includes:

a main unit connector which is arranged at a position adjacent to a side face of the supporting member of the process cartridge, which is electrically connected to the cartridge side connector when the process cartridge is attached to the main unit; and an exposure device which scans, in the direction of the rotation axis, by an exposure light beam, the image holding member included in the process cartridge attached to the main unit, and the main unit connector is arranged at a position not only overlapping an irradiation region of the exposure light beam on the image holding member in an irradiation direction of the exposure light beam, but also avoiding, with respect to the direction of the rotation axis, an area where the exposure light beam passes through.

2. An image forming apparatus, comprising:

a main unit; and a process cartridge that includes:

an image holding member which rotates about a rotation axis;

a developing device which develops a latent image on the image holding member; and a supporting member which is formed with a side face spreading in a direction of the rotation axis and supports the image holding member and the developing device, and a cartridge side connector on the side face of the supporting member, wherein the process cartridge is moved in the direction of the rotation axis so as to be attached and detached to and from the main unit, the main unit includes:

a main unit connector which is arranged at a position adjacent to a side face of the supporting member of the process cartridge, which is electrically connected to the cartridge side connector when the process cartridge is attached to the main unit; and an exposure device which scans, in the direction of the rotation axis, by an exposure light beam, the image holding member included in the process cartridge attached to the main unit, and the main unit connector is arranged at a position not only being closer to a side of scanning by the exposure light beam than the process cartridge but also avoiding, with respect to the direction of the rotation axis, an area where the exposure light beam passes through;

wherein the main unit includes a guide member which guides attachment and detachment of the process cartridge, and the main unit connector is attached to the guide member.

3. The image forming apparatus according to claim 2, wherein the process cartridge further includes:

a storage device which stores information representing a state of the process cartridge; and a storage device connector which is arranged adjacently to the cartridge side connector on the side face of the supporting member and which is electrically connected together with the cartridge side connector to the main unit connector.

4. The image forming apparatus according to claim 2, wherein the process cartridge further includes:

a storage device which stores information representing a state of the process cartridge; and a storage device connector which is arranged adjacently to the cartridge side connector on the side face of the supporting member and which is electrically connected together with the cartridge side connector to the main unit connector.

5. The image forming apparatus according to claim 2, wherein the cartridge side connector is connected to a sensor which detects toner density.

6. The process cartridge according to claim 5, further comprising:

a storage device which stores information representing a state of the process cartridge; and a storage device connector which is arranged adjacently to the cartridge side connector on the side face of the supporting member and which is electrically connected together with the cartridge side connector to the main unit connector when the process cartridge is attached to the main unit.

* * * * *